United States Patent [19]

Karevaara

[11] 4,102,454

[45] Jul. 25, 1978

[54] CONICAL DISPOSABLE MUG

[75] Inventor: Juhani Karevaara, Hameenlinna, Finland

[73] Assignee: Huhtamaki Oy, Hameenlinna, Finland

[21] Appl. No.: 791,596

[22] Filed: Apr. 27, 1977

[51] Int. Cl.[2] ..... B65D 21/02; B65D 3/28

[52] U.S. Cl. ..... 206/514; 206/519; 229/1.5 B; 229/52 A

[58] Field of Search ..... 206/519, 520, 514; 229/1.5 B, 52 A

[56] References Cited

U.S. PATENT DOCUMENTS

| | | | |
|---|---|---|---|
| 2,060,781 | 11/1936 | Annen | 229/1.5 B |
| 2,563,352 | 8/1951 | Morse | 229/1.5 B |
| 2,775,382 | 12/1956 | Kagat | 229/1.5 B |
| 3,094,240 | 6/1963 | Wanderer | 206/519 |

FOREIGN PATENT DOCUMENTS

| | | | |
|---|---|---|---|
| 1,201,792 | 1/1960 | France | 206/519 |

*Primary Examiner*—George E. Lowrance
*Attorney, Agent, or Firm*—Haseltine, Lake & Waters

[57] ABSTRACT

Disposable mug of conical shape, the kind of which mugs may be assembled, by placing them within each other, to stacks fitting in an automatic dispenser, and which mug comprises projections provided on the side of the mug and a handle lying substantially parallel to the side and which may be formed into a grip by bending it. On the side of the mug projections have been formed substantially annularly both above and below the handle and that the extension of said projections is at least equal to the thickness of the handle.

1 Claim, 7 Drawing Figures

CONICAL DISPOSABLE MUG

Nowadays drinking beakers or mugs which are disposable are made of cardboard, having the shape of a truncated cone and of which it is possible by placing them inside each other to compose high stacks. Such densely packed stacks are favourable in view of transport and storage and the stack may as such be placed in a dispenser from which the mugs may be withdrawn one at a time. Especially in view of facilitating the drinking of hot beverages, one has attached a handle to disposable mugs made of cardboard. To this purpose to the side of the mug a handle flattened against the side has been attached, which can be bent outwardly and may hereby be formed into a gripping means immediately prior to use of the mug. In addition to the handle there may on the side of the disposable cardboard mug also be projections close to the upper rim of the mug, which mainly serve the purpose of facilitating the attachment of a cover to the mug.

The present disposable drinking mugs with handle are however encumbered by drawbacks which impede the efficient use of automatic dispensers in the dispensing of mugs to the user. When said mugs are being manufactured, the handles will be in the stacks composed of completed mugs invariably on the same side of the stack. As a result hereof the stack develops a tilt and the mugs are pressed very tightly together in the stack. The feed tube of the dispenser in which the stack of mugs is inserted is straight however, and friction will therefore occur between the stack and the feed tube. The circumstance that the mugs are difficult to separate also impairs the appropriateness of existing drinking mugs with handles for use in dispensers.

The object of the present invention is to eliminate the drawbacks mentioned and to accomplish a disposable mug with handle which is particularly fit for use in dispensers. The invention is characterized in that on the side of the mug projections have been formed substantially annularly both above and below the handle and that the extension of said projections at least equals the thickness of the handle. The projections may constitute on the side of the mug continuous or interrupted rings encircling the mug substantially in a horizontal plane, or there may also be on the side of the mug substantally annular aggregations consisting of discrete projections and having the required extension. When such mugs are assembled to form a stack, there remains owing to the projections a free space between the mugs, in which space the handle resides. Since now the handles cannot bend the stack to become curved, such a stack is formed of the drinking mugs of the invention which is easy to insert in the feed tube of the dispenser and which moves in the feed tube without any worthwhile friction between the wall and the stack. Moreover, the drinking mugs of the invention are separable more easily than in prior art.

The projections located annularly on the side of the mug may be found on the inner side or on the outer side of the mug. The projections may even be formed in such manner that the are located above the handle on the inner side of the mug and below the handle on the outer side of the mug, or vice versa. All these different embodiments have the feature in common that it is possible to leave between the stacked mugs a free space for the handle.

In an advantageous embodiment of the invention, in view of reducing the extension in the direction perpendicular to the side of the handle belonging to the mug, there has been arranged a loose adhesion between the handle and the side of the mug. The adhesion keeps the handle pressed against the side of the mug and thereby facilitates the separation of the stacked mugs. The adhesion may be accomplished e.g. with the aid of a drop of glue, whereby it does not impede the outward bending of the handle when a gripping means is being formed.

The invention is described in detail in the following with the aid of examples, with reference being made to the attached drawing, wherein:

FIG. 1 presents a disposable drinking mug according to the invention.

Figure 1:
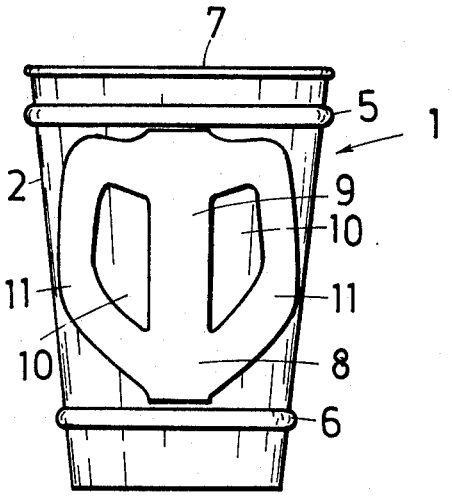
Figure 5:
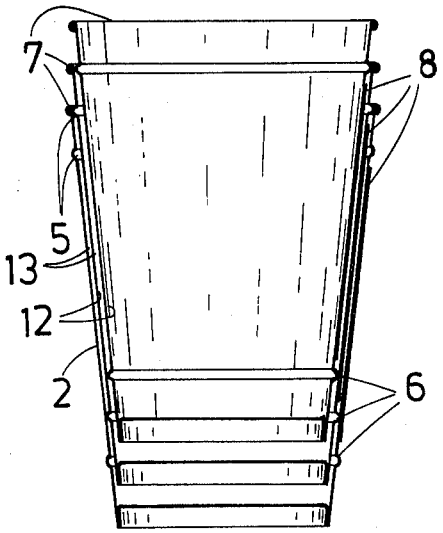

FIG. 5 presents, in sectional view, stacked mugs according to FIG. 1.

Figure 2:
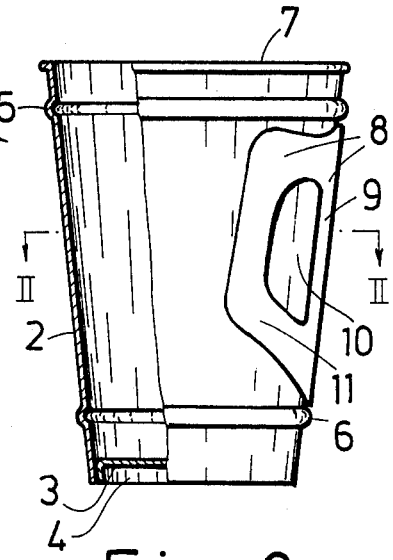
FIG. 2 shows the mug of FIG. 1 in elevational view and partly sectioned.
Figure 6:
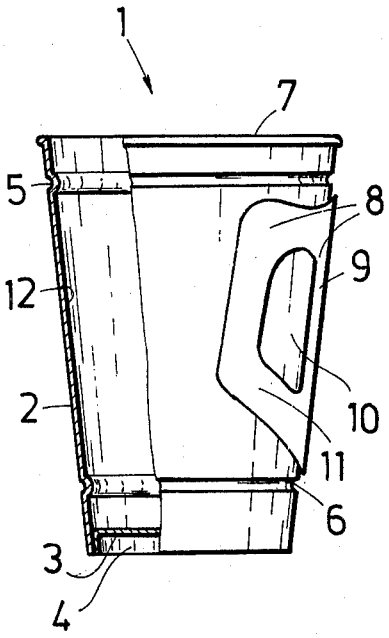
Figure 7:
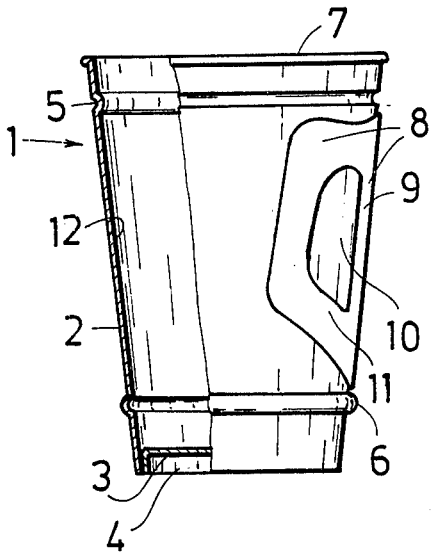

FIGS. 6 and 7 are equivalent to FIG. 2, showing other embodiments of the invention.

Figure 3:
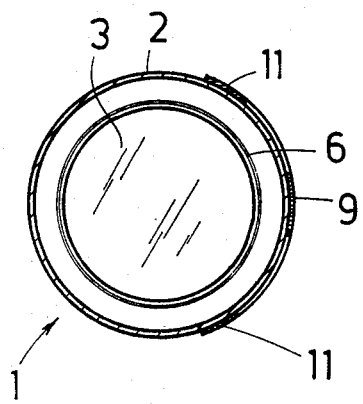
FIG. 3 shows the section II—II of FIG. 2.

In FIGS. 1 to 3, a disposable drinking mug 1 according to the present invention has been shown, which is made in its entirety of cardboard and which has the shape of a truncated cone. The mug 1 comprises a side 2 of circular cross section and a round bottom 3. The side 2 of the mug has been arranged to continue past the bottom 3 so that on the bottom of the mug a shallow depression 4 is formed. On the outer side 2 of the mug two annular projections 5,6 have been provided, which encircle in a horizontal plane the side 2 of the mug. The projection 5 is located close to the upper rim 7 of the mug 1, and the projection 6, again, is located close to the bottom 3 of the mug. Between the projections 5,6, which are comparatively widely spaced, the handle 8 has been placed, which rests tightly against the outer side 2 of the mug 1. The handle 8 comprises a substantially vertical, strip-like part 9, on the area of which the handle has been glued tightly to the outer side 2 of the mug. On either side of said strip-like part 9 there is an aperture 10 and a strip-like handle flap 11 defining this aperture. Both handle flaps 11 have been affixed with a drop of glue to the side 2 of the mug in such manner that a loose adhesion has been established between the handle flaps 11 and the mug side 2. The thickness of the flaps 11 and strip-like part 9 belonging to the handle 8 is slightly less than the extension of the annular projections 5,6 in the direction at right angles to the side 2. Owing to the adhesion provided between the flaps 11 and the mug side 2, the handle 8 does not project at any point farther than the projections 5,6. The disposable mug made of cardboard furthermore comprises a seam produced at the manufacturing step, but which has not been depicted in FIGS. 1 to 3 as being an unessential thing in view of the invention.

The drinking mugs 1 of the invention may be placed within each other and thus be assembled to form high stacks. In FIG. 5, three mugs of FIG. 1 have been shown stacked. When two mugs are placed inside each other the inner side 12 of the lower mug and the other side 2 of the upper mug will be opposite each other, and by action of the annular projections 5,6 belonging to the upper mug there remains between the said sides of free space 13 encircling the outer side of the upper mug. The thickness dimension of this space 13 is at least equal to the thickness of the handle 8, whereby the handle fits into the said space and thus cannot bend the stack of mugs into curved shape. Owing to the adhesion between the flaps 11 and the outer side 2 of the mug, the handle does not press against the inner side of the lower mug and therefore causes no friction when the mugs placed inside each other are separated.

Figure 4:
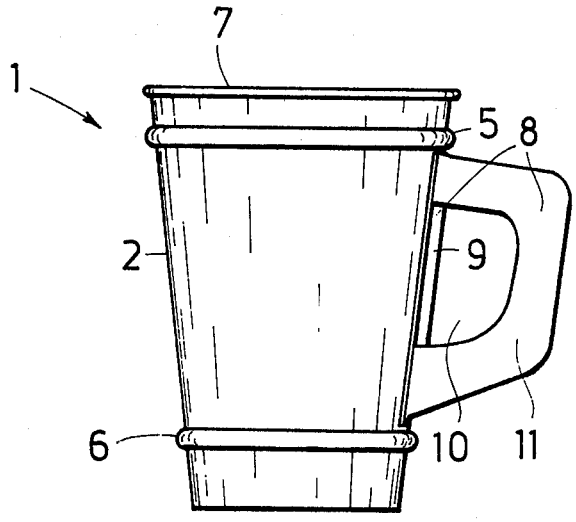
FIG. 4 shows the drinking mug of FIG. 1 and the handle of which has been bent to form a gripping means.

In FIG. 4 a drinking mug 1 according to FIG. 1 has been shown wherein the handle 8 has been formed by bending into a gripping means. This is accomplished by gripping with the hand the flaps 11 and pulling them outwardly from the mug side 2, whereby the loose adhesion established by means of glue drops will yield and the flaps will come loose from the side of the mug. The flaps are finally pressed together, whereby the handle 8 forms a gripping means attaching by the strip-like part 9.

In FIG. 6 an embodiment of the invention is presented wherein the annular projections 5,6 have been formed on the inner side 12 of the mug 1. When such mugs are placed inside each other, there is formed between the sides 2,12 of the mugs by action of the projections belonging to the lower mug, a free space. In all other respects the mug conforms to the example presented above. In the drinking mug of FIG. 7 the projection 5 located above the handle 8 is found on the inner side 12 of the mug, and the projection located below the handle and carrying the reference numberal 6, on the outer side 2 of the mug. It is similarly possible to provide the projection formed above the handle, on the outer side of the mug, and the projection to be provided below the handle, on the inner side of the mug. In both instances the mugs may be stacked as in the preceding examples.

It is obvious to a person skilled in the art that different embodiments of the invention are not confined to the example presented, but that they may vary within the scope of the claims following below. For instance, the construction and shape of the handle may be altogether arbitray. It is merely essential that the handle is thin enough to find place within the space defined by the mugs placed inside each other and by the annular projections. The adhesion between the handle and the mug side may be established not only by means of a glue drop but in any other convenient way, e.g. by hot seaming. However, the adhesion has to be loose enough to yield readily when the gripping means is being formed. The projections on the side of the mug may also differ considerably from the continuous, horizontal rings shown in the attached drawing. The projections may for instance be small eminences arranged on the side of the mug substantially in annular configuration.

I claim:

1. A disposable drinking container formed to be stacked with respect to similar containers, and to form a plurality of stacked containers one within another, said container including: a bottom wall, a conical shaped side wall extending upwardly from said bottom wall, a handle secured to the exterior of said side wall being formed of two flat co-acting members; said handle being secured to said side wall in parallel relation thereto and being adapted to bend outwardly; several protuberance means disposed on the outer periphery of said side wall disposed above and below said handle, said protuberance means being spaced apart from one another projecting outwardly for an amount equal to that of the thickness of said handle therebetween, whereby, each of said containers in stacked relation form an annular chamber circumscribed by respective protuberance means of an inner container and inner wall surface of an outer container; and said handle being disposed within said chamber.

* * * * *